US005520116A

United States Patent [19]

Toyre

[11] Patent Number: 5,520,116

[45] Date of Patent: May 28, 1996

[54] DETACHABLE GRIP FOR A VEHICLE TOWED BY A CABLE

[75] Inventor: Georges Toyre, Seyssinet-Pariset, France

[73] Assignee: Pomagalski S.A., France

[21] Appl. No.: 412,690

[22] Filed: Mar. 29, 1995

[30] Foreign Application Priority Data

Apr. 22, 1994 [FR] France ..... 94 05120

[51] Int. Cl.[6] ..... B61B 12/12

[52] U.S. Cl. ..... 104/209; 104/203; 104/214; 104/216

[58] Field of Search ..... 104/202, 203, 104/204, 209, 214, 216

[56] References Cited

U.S. PATENT DOCUMENTS

| | | | |
|---|---|---|---|
| 813,040 | 2/1906 | Davis | 104/216 |
| 2,120,066 | 6/1938 | Dwight | 104/218 |
| 2,772,639 | 12/1956 | Ingold | 104/216 |
| 3,435,782 | 4/1969 | Stewart | 104/214 |
| 3,541,962 | 11/1970 | Avery | 104/214 |
| 3,871,303 | 3/1975 | Woodling | 104/214 |
| 4,403,552 | 9/1983 | Kunczynski | 104/216 |

FOREIGN PATENT DOCUMENTS

| | | | |
|---|---|---|---|
| 2337067 | 7/1977 | France . | |
| 432936 | 1/1925 | Germany | 104/209 |
| 1237161 | 3/1967 | Germany . | |
| 23328 | of 1900 | United Kingdom | 104/214 |
| 81/02275 | 8/1981 | WIPO . | |

*Primary Examiner*—Robert J. Oberleitner
*Assistant Examiner*—S. Joseph Morano
*Attorney, Agent, or Firm*—Parkhurst, Wendel & Burr

[57] ABSTRACT

Vehicles of a passenger transport installation are hauled along a track by a traction cable. Each vehicle is equipped with a detachable grip having a pair of jaws for clamping the traction cable. A grip control mechanism comprises a toggle device with a spring, arranged so as to exert a cable clamping force when the toggle is in the straightened position, further to the dead center position. The toggle device provides a safe lock against accidental opening movement of the jaws.

4 Claims, 4 Drawing Sheets

DETACHABLE GRIP FOR A VEHICLE TOWED BY A CABLE

BACKGROUND OF THE INVENTION

1. Field of the Invention

The invention relates to a detachable grip for coupling a vehicle or a car to a traction cable of a passenger transport installation. The vehicle runs on rails or runways at a high speed and stops or runs at low speed in the stations for loading and unloading of the passengers. The track is subdivided into a number of successive track sections, each equipped with a traction cable, and the detachable grip is controlled to couple and uncouple the vehicle to the traction cable.

2. Description of the Prior Art

A vehicle of the kind indicated has a grip for gripping on the line a continuously moving high speed traction cable, extending between two stations, and at the level of the stations a deceleration or acceleration cable. The known grip is complicated and devices for checking the adequate clamping of the cable by the grip are necessary in order to prevent any dangerous slip along the cable.

SUMMARY OF THE INVENTION

The object of the present invention is to provide a simple grip, arranged to lock itself against accidental release of the grip, that grip being particularly adapted to vehicles of passenger transport installations in urban areas. The detachable grip in accordance with the invention has a control mechanism, which is secured to the bottom of the vehicle or housed inside this bottom, and this control mechanism has a pair of jaws for clamping the traction cable which extends under the bottom of the vehicle, substantially at the level of the rails. The vehicle has a keel protruding vertically downwards and having a horizontally curved free end, which extends transversely to the track and which carries a fixed jaw and a movable jaw. The movable jaw is mounted so as to slide on the horizontal part of the keel in the direction of the closing of these jaws for clamping the cable or in the opposite direction of the opening the jaws for releasing the cable. A vertical axis is rotatably mounted inside the keel and carries on each of its ends a crank. The lower crank is hinged on the movable jaw and the upper crank is hinged on the control mechanism, so that the opening and the closing of the jaws are operated by rotations of the axis. The control mechanism comprises a toggle device, so arranged that when the toggle is moved by a jack into the straightened position, slightly further than its dead center position, the jaws are moved and locked into the gripping position. The jaws are in the open position when the toggle has been moved into the folded position. The rotatably mounted axis and the associated cranks provide a link between the movable jaw and the control mechanism and the position of the upper crank represents with accuracy the position of the grip. The toggle device comprises a spring to draw the toggle towards the opening position of the jaws, when they are in this position, and towards the closing position, when the jaws are in the latter position. The actuating jack, for instance an hydraulic jack, is pivotally secured to the center of the toggle and so arranged that the actuating force, exerted by the jack for moving the jaws into the closed position, is in a first stage very small. This force increases rapidly to a maximum value when the jaws come into contact with the cable and when the jaws clamp the cable.

Thereafter the actuating force decreases and even becomes negative when the toggle is moved further to its dead center position. It is clear that the jaws are automatically moved into the closing position of the grip as soon as the actuating force of the jack is higher than said maximum value. In the same manner the jaws are automatically moved into the opening position when the jack, applying an opposite actuating force, has moved the toggle into the opposite side of the dead center position.

The toggle device comprises two levers pivotally secured to the center of the toggle, at least one of these levers being a telescopic lever drawn towards the extended position by a coaxial expansion or compression spring. One end of the toggle is pivotally fixed to the bottom of the vehicle or to a horizontal mounting plate, and the opposite end of the toggle is pivotally secured to the upper crank.

DESCRIPTION OF THE PREFERRED EMBODIMENT

The invention will be further described, by way of example, with reference to the accompanying drawings, in which.

Figure 1:
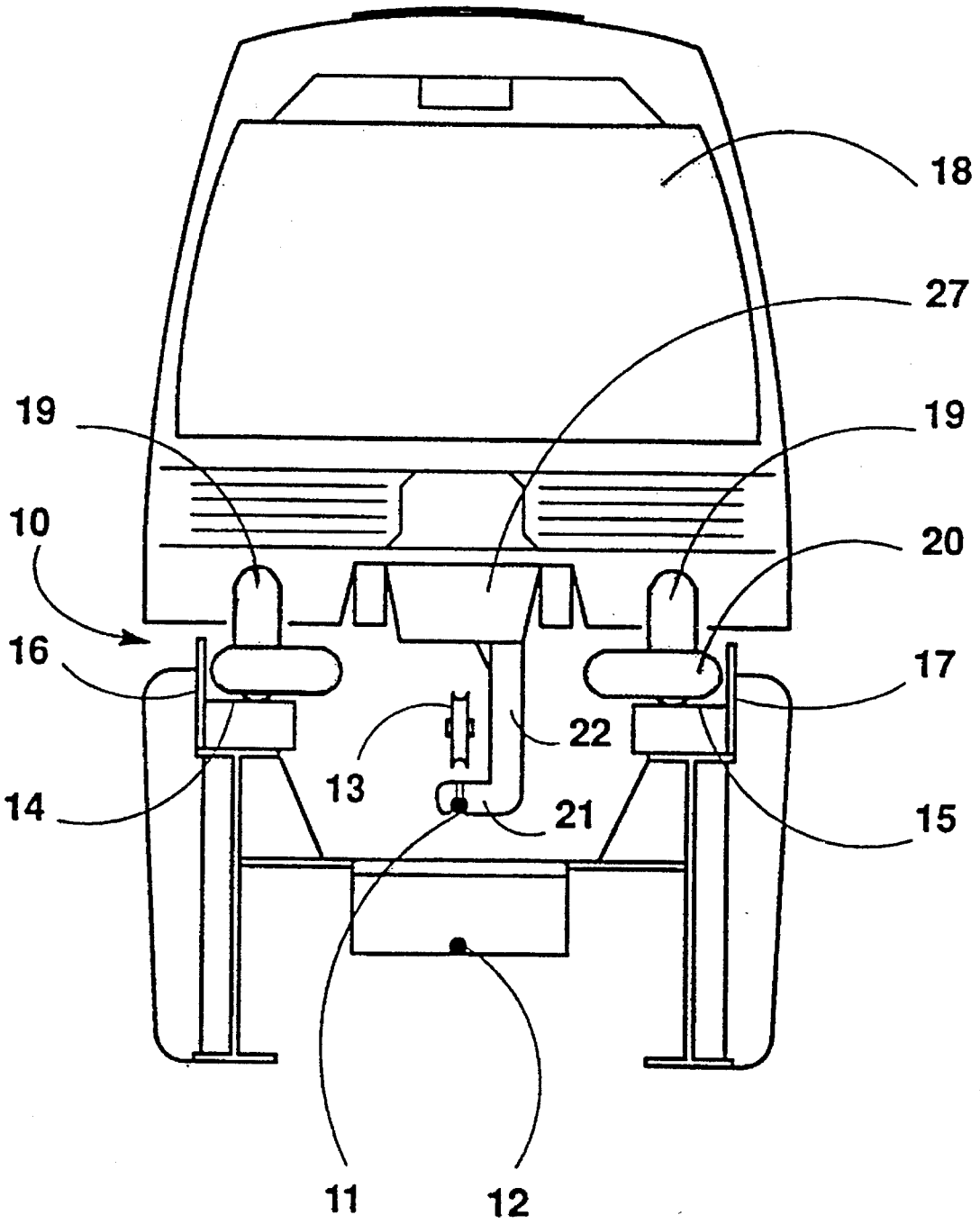
FIG. 1 is a schematic end view of a vehicle of a transport installation in accordance with the invention.

In these figures a track 10 of a passenger transport installation, in particular in urban areas, has two runways 14,15 and two lateral guide rails 16,17. The vehicles 18 running on the track 10 have supporting wheels 19, which roll on the runways 14,15 and guide wheels 20 which roll on the guide rails 16,17 and these wheels 19,20 are preferably pneumatic tires. The track may be a railway track or a cableway track and the wheels of the vehicles may be metallic. The vehicles 18 are towed on track 10 by a traction cable 11 extending substantially at the level and in the middle of the runways 14,15. The traction cable 11 passes in the stations over a return bull wheel (not shown) to form an endless cable loop, having a return portion 12 located below the level of the runways 14,15. The traction cable 11 is driven by a motor connected to one of the bull wheels and is guided by support or hold-down sheaves 13. The vehicle 18 comprises a detachable grip 21, secured to the bottom of the vehicle for coupling the vehicle to the traction cable 11 and for hauling the vehicle on the track 10. The passenger transport installation is preferably of the kind disclosed in copending U.S. patent appl. No. 08/183,934, filed Jan. 21, 1994, with vehicles coupled to the traction cable during the whole travel on a track section between two stations. At the station the traction cable and the vehicle are stopped for loading and unloading of the passengers and the vehicle is uncoupled from the traction cable of this track section for coupling to the traction cable of the successive track section, to be driven by this traction cable along this successive track section. The invention may be applied to installations having a continuously moving high speed traction cable and at the level of the stations deceleration and acceleration cables as described in the U.S. Pat. No. 3,871,303.

The grip 21 comprises a keel 22 with a vertical part 23 mounted substantially in the middle on the underside of the vehicle and with an horizontal curved extending part 24, arranged transversely above the traction cable 11. The vertical part 23 is transversely shifted so as to allow the passing of the grip near the cable hold-down sheaves 13. A pair of jaws are mounted on the horizontal part 24, one jaw 25 being fixed and the other jaw 26 being movable to constitute a detachable grip. The movable jaw 26 is slidably mounted on the horizontal part 24 and linked to a control mechanism 27 secured to the bottom of the vehicle 18. This control mechanism 27 operates the opening and the closing of the grip 21 for uncoupling and coupling the vehicle 18 from/to the traction cable 11.

Figure 2:
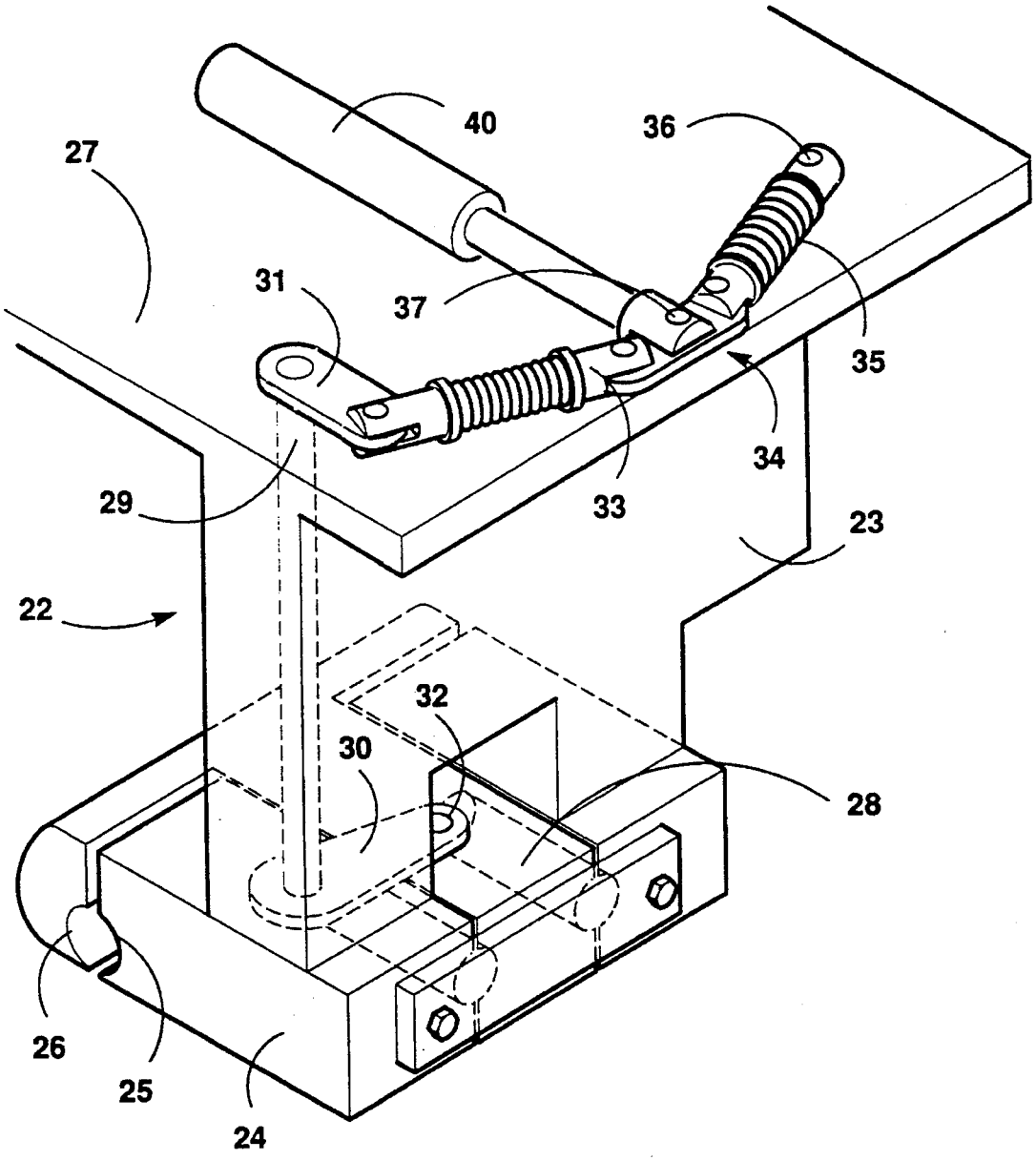
FIG. 2 is a schematic perspective view of the grip, shown in FIG. 1.
Figure 3:
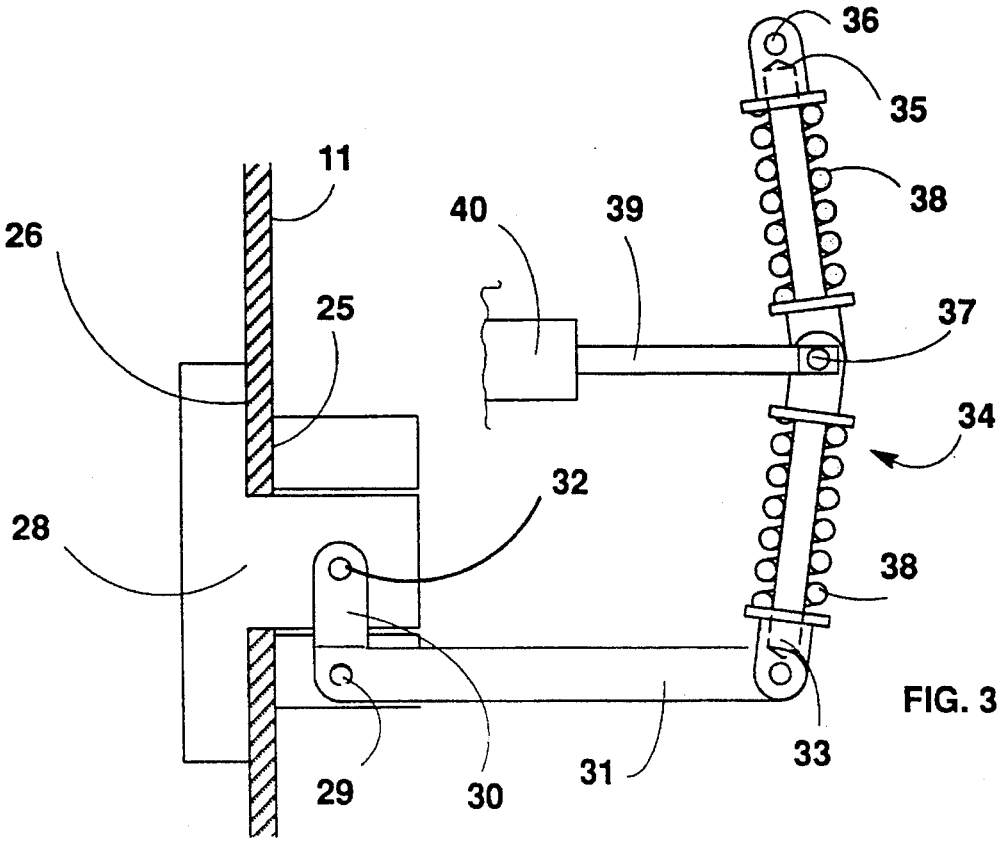
FIGS. 3 and 4 show in plan the grip, respectively in its closed and open positions.
Figure 4:
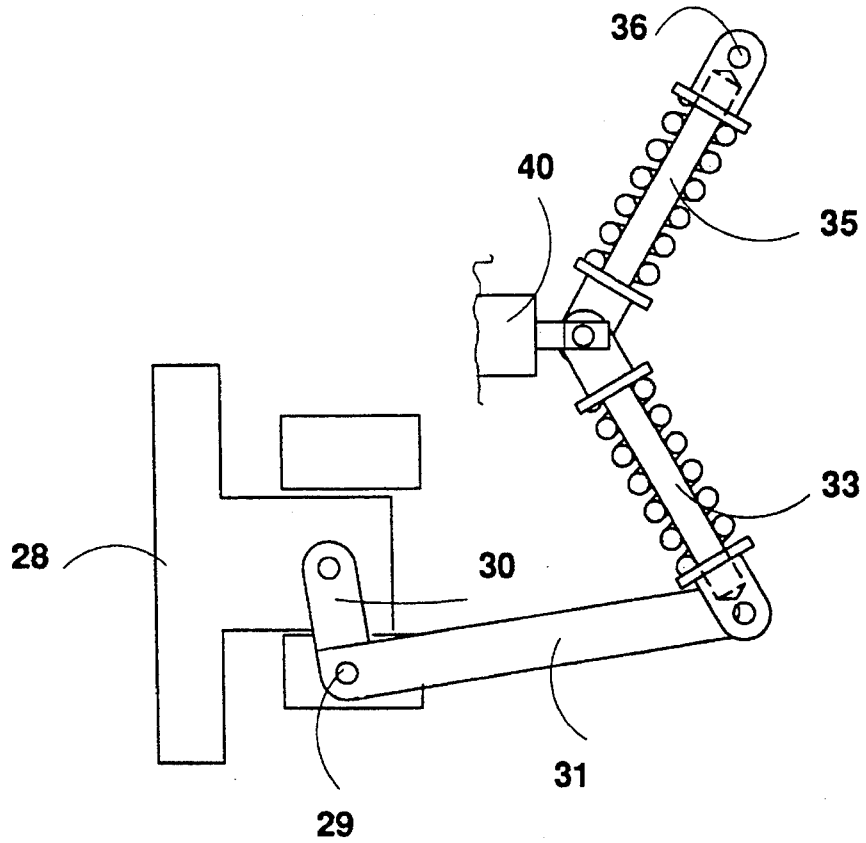

Referring more particularly to FIGS. 2–4, it is seen that the horizontal part 24 comprises a fork shaped body having a grooved end constituting the fixed jaw 25. A slider 28 is inserted between the two branches of the fork shaped body and carries on its end the movable jaw 26 facing the fixed jaw 25. When the slider 28 slides, transversely to the track 10, to the right in FIG. 2, the movable jaw 26 moves towards the fixed jaw 25 for closing the grip and clamping the traction cable 11, and inversely. A vertical rigid axis 29 is rotatably mounted inside the vertical part 23 of the keel 22. The lower end of the axis 29 carries a lower crank 30 having an end 32 pivotally secured, with some lateral play, to the slider 28, so that a rotation of the axis 29 moves the slider 28. The upper end of the axis 29 carries an upper crank 31, which is pivotally secured to a lever 33 of a toggle mechanism 34, having a center pin 37 and another lever 35 having its end 36 pivotally fixed. Each lever 33,35 comprises two telescopic parts and a compression spring 38, which is inserted between these parts so as to draw the telescopic lever into the extended position. The piston rod 39 of a jack 40, for instance an hydraulic or pneumatic jack, is pivotally secured to the toggle 34 center pin 37 for controlling the position of the toggle 34.

When the grip 21 is in the closed position shown in FIG. 3, the jaws 25,26 clamp the traction cable 11, and the toggle 34 is in the straightened position, slightly past its dead center position, this straightened position being defined by the limited stroke of the piston of the jack 40. The compressed springs 38 exert on the upper crank 31 a force which tends to rotate the upper crank 31, the axis 29 and the lower crank 30 in the clockwise direction. This force is transmitted to the slider 28 and provides the clamping force of the jaws 25,26. The spring force 38 maintains the toggle 34 in this over dead center position and this straightened toggle position forms a positive and safe lock against an accidental relaxation of the grip of the jaws 25,26 on the traction cable 11. When the jack 40 is actuated to move the piston rod 39 and the center pin 37 to the left in FIG. 3, the levers 33,35, the cranks 30,31 and the slider 28 all move towards the position shown in FIG. 4, so as to release the traction cable 11. As soon as the toggle levers 33,35 come in alignment, the spring force 38 and the jack force 40 work together to move the center pin 37 to the left in FIG. 4 so as to provide a positive lock. When the jack 40 is actuated in the opposite direction the grip is moved from the position in which it is shown in FIG. 4 into the position it is shown in FIG. 3.

Figure 5:
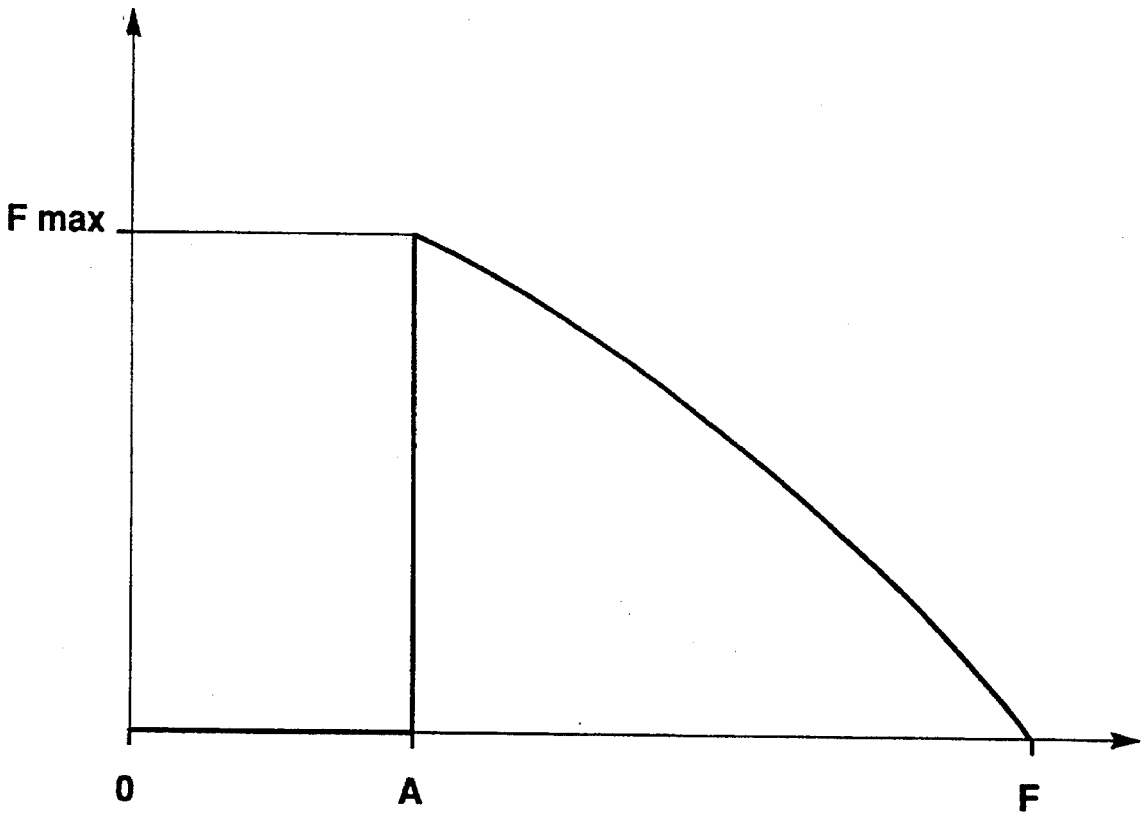
FIG. 5 shows the variation of the actuating force during the closing of the grip.

FIG. 5 shows the force exerted by the jack 40 on the toggle center pin 37 for moving the grip from the opening position O (FIG. 4) into the closing position F (FIG. 3). During the movement of the jaws 25,26 from the opening position O to the position A in contact with the cable 11 the force is very small. The force increases rapidly to a maximum value Fmax during the clamping of the cable, and thereafter decreases when the toggle 34 moves toward the straightened position to become at last slightly negative. It is clear that the closing movement proceeds automatically further as soon as the maximum value Fmax is reached and that the grip does not remain in an intermediate position. An ungripment or a release of the gripping pressure is thus avoided. The grip mechanism is simple and the toggle device together with the jack, which extend in the same plane, may be secured under the bottom of the vehicle or inside this bottom.

What is claimed is:

1. A detachable grip for coupling a vehicle to a traction cable extending along a track of a passenger transport installation, comprising:

a keel including a horizontal part and a vertical part connected together, said horizontal part including a fixed jaw and a movable jaw, said movable jaw being slidable with respect to the fixed jaw to clamp a traction cable therebetween in a closed position, and to release the traction cable in an open position;

upper and lower cranks respectively secured to upper and lower ends of a rotatable connecting rod, said lower crank being connected to said movable jaw to slide said movable jaw; and a control device including a toggle mechanism to control movement of the movable jaw, said toggle mechanism comprising a spring means to apply a clamping force to the traction cable in the closed position of the jaws, and first and second levers each having first and second ends, said first ends being pivotally joined together, the second end of the first lever being pivotally fixed and the second end of the second lever being pivotally secured to the upper crank, wherein the toggle mechanism is pivotal from a substantially straightened position to apply the clamping force, past a dead center position, to a collapsed position to open the jaws.

2. The grip of claim 1, wherein said spring means comprises a spring, and one of said first and second levers is a telescopic lever that extends through said spring, said spring biasing said telescopic lever to an extended position.

3. The grip of claim 1, wherein the first ends of the first and second levers are pivotally joined to a piston for actuating the toggle device between the substantially straightened and collapsed positions.

4. The grip of claim 3, wherein said piston is slidable in a jack through a stroke that is limited, said straightened position of the toggle device being defined by a furthermost limit of the stroke of the piston.

* * * * *